US005981021A

United States Patent [19]

McCulloch

[11] Patent Number: 5,981,021

[45] Date of Patent: Nov. 9, 1999

[54] TRANSFER PRINTING FLOCKED FABRIC

[75] Inventor: James R. McCulloch, Providence, R.I.

[73] Assignee: Microfibres, Inc., Pawtucket, R.I.

[21] Appl. No.: 09/192,393

[22] Filed: Nov. 13, 1998

Related U.S. Application Data

[63] Continuation of application No. 08/976,841, Nov. 24, 1997, abandoned, which is a continuation of application No. 08/775,666, Dec. 31, 1996, abandoned, which is a continuation of application No. 08/622,928, Mar. 27, 1996, abandoned, which is a continuation of application No. 08/477,278, Jun. 7, 1995, abandoned, which is a continuation of application No. 08/293,749, Aug. 22, 1994, abandoned, which is a continuation of application No. 07/922,918, Jul. 31, 1992, abandoned.

[51] Int. Cl.[6] ..... D06P 5/00; D06M 17/04

[52] U.S. Cl. ..... 428/97; 428/90; 428/96; 8/471; 8/488; 8/467

[58] Field of Search ..... 8/471, 488; 428/90, 428/96, 97

[56] References Cited

U.S. PATENT DOCUMENTS

| | | | |
|---|---|---|---|
| 2,308,429 | 1/1943 | Smith et al. | 117/66 |
| 3,099,514 | 7/1963 | Haber | 8/66 |
| 3,568,594 | 3/1971 | Johnston et al. | 101/152 |
| 3,999,940 | 12/1976 | Freeman | 8/14 |
| 4,018,956 | 4/1977 | Casey | 428/86 |
| 4,049,374 | 9/1977 | Rejto | 8/2.5 |
| 4,108,595 | 8/1978 | Pappas | 8/1 A |
| 4,294,577 | 10/1981 | Bernard . | |
| 4,309,179 | 1/1982 | Heuser et al. | 8/558 |
| 4,314,813 | 2/1982 | Masaki | 8/468 |
| 4,427,414 | 1/1984 | Orton | 8/480 |
| 4,963,422 | 10/1990 | Katz et al. | 428/90 |

FOREIGN PATENT DOCUMENTS

| | | |
|---|---|---|
| 90 372556 | 7/1990 | Japan . |

*Primary Examiner*—Margaret Einsmann
*Attorney, Agent, or Firm*—Rhodes & Mason, PLLC

[57] ABSTRACT

A transfer printed, flocked fabric includes a textile substrate, raised nylon fibers on the substrate, a black-pigmented adhesive adhering the nylon fibers to the substrate and disperse dye distributed in a pattern in upper portions of the nylon fibers and the upper portions of the nylon fibers being colored only by disperse dye, thereby forming a deep, dark, crock-fast, colored print.

20 Claims, 2 Drawing Sheets

TRANSFER PRINTING FLOCKED FABRIC

This application is a continuation of U.S. patent application Ser. No. 08/976,841 filed Nov. 24, 1997, now abandoned; which was a continuation of U.S. patent application Ser. No. 08/775,666 filed Dec. 31, 1996, now abandoned; which was a continuation of U.S. patent application Ser. No. 08/622,928 filed Mar. 27, 1996, now abandoned; which was a continuation of U.S. patent application Ser. No. 08/477,278 filed Jun. 7, 1995, now abandoned; which was a continuation of U.S. patent application Ser. No. 08/293,749 filed Aug. 22, 1994, now abandoned; which was a continuation of U.S. patent application Ser. No. 07/922,918 filed Jul. 31, 1992, now abandoned.

BACKGROUND OF THE INVENTION

The present invention relates to improvements in transfer printing on flocked fabrics.

Flocked fabrics are known to be made by adhering short fibers, typically nylon or polyester to a substrate using, conventionally, a clear adhesive. The fibers may be pre-dyed, known as fiber-dye, or in their natural state, in which they are a white, translucent color.

Transfer printing entails combining a paper having the dyestuffs for the fabric arrayed on it in a print pattern, placing the paper and fabric into intimate contact and exposing the paper and fabric to pressure and heat. The result is the sublimation of the disperse dye and its entry into the fibers of the fabric. It is conventional for transfer print papers to have the print arrayed over the entire extent of the paper, so that the pattern to be printed can be seen in reverse on the paper itself. Transfer printed fabrics, having been exposed to heat and pressure in the printing process typically have a flat and papery look and hand. This is often deemed undesirable, especially in a flocked fabric.

It is known to add pigment to an adhesive used in some flocked fabric manufacturing. In one case, the pigmented adhesive is used to bind flock on fabric which is subsequently printed using wet processing techniques to achieve deep rich colors. However wet processing involves very different considerations from transfer printing, which is a lower-cost, dry process. Tinted adhesives are also known for use with pre-dyed flock, to obtain an overall intensity of shade.

However, it has not been possible previously in printing the flocked fabrics with transfer printing to achieve deep, dark shades using conventional print papers. When this is attempted, there are problems of grin-through, crocking and inferior lightfastness. The fabric substrate can be seen between the fibers, interfering with the desired visual effect of the printed pattern. Efforts to add dyestuff to the print paper in order to achieve deeper shades have been unsuccessful because the dyestuff in such a heavy concentration is not fully absorbed into the fibers. As a result, the dyestuff can rub off, an undesirable and commercially unacceptable result. The rubbing off of the colors in this fashion is known as "crocking".

Accordingly, there is a need in the art for an improved method for transfer printing onto flocked fabrics to achieve deep, dark shades, and also a need for deep, darkly transfer printed flocked fabrics.

SUMMARY OF THE INVENTION

The present invention fulfills this need in the art by providing a transfer printed, flocked fabric comprising a textile substrate, raised thermoplastic fibers on the substrate, a dark pigmented adhesive adhering the fibers to the substrate and disperse dye distributed in a pattern in upper portions of the thermoplastic fibers. The disperse dye makes a deep, dark colored print. In a preferred embodiment the pigment is black. Other dark pigments usable include those which are blue, green or red. Typically, the upper portions of the fibers are colored only by disperse dye. The invention results in the dyed pattern being crock-fast. The fibers are typically nylon or polyester.

The printed fabrics may have loftier, more erect pile than conventional transfer printed flocked fabrics, and a softer hand.

The fibers may be arrayed on the substrate in a textured array, so that some fibers diverge from neighboring fibers more than other fibers and the pigmented adhesive is visible between the diverging fibers.

The invention also includes a method of printing a flocked fabric including adhering undyed thermoplastic fibers to a substrate with a pigmented adhesive so that the fibers have a lower portion adhered to the substrate and an upper portion forming a nap and thereby forming a flocked fabric, and transfer printing the flocked fabric. Preferably, the adhering step comprises adhering the fibers with a darkly pigmented adhesive. The adhering step may include adhering nylon fibers.

In one embodiment the adhering step includes adhering the fibers with a black pigmented adhesive.

The invention preferably includes heat setting the flocked fabric between the adhering step and the transfer printing step. Alternatively, the flocked fabric may be thermally brushed after the transfer printing step. The transfer printing step preferably includes printing with a pattern having deep, dark colors.

The adhering step may include texturizing the fibers on the substrate to cause some fibers to diverge from neighboring fibers more than other fibers so the pigmented adhesive is visible between the diverging fibers.

Typically, when using the method of the invention the printing step may include pressing the fabric to a transfer print paper at pressures lower than in conventional transfer printing. For example, the pressure may be between about 10 and about 59 pounds.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

The present invention is made possible, in part by preparation of the flocked fabric. In lieu of using the conventional clear adhesives used for adhering the flock to the substrate, a pigmented adhesive is substituted. The adhesive may be any adhesive conventionally used for adhering flock to substrates in making flocked fabrics, including those available from B.F. Goodrich, 9911 Brecksville Rd., Brecksville, Ohio, and other suppliers. A pigment is added to the basic adhesive, the precise color of the pigment being dictated by desired results. Preferably, the pigment is of a dark color to help achieve the deep, dark color in the printed fabric. The pigment may be black or other dark shades such as navy blue, dark red, dark green, or the like.

The adhesives are typically water-based acrylic polymers. Conventional processing of the adhesive may also be used including viscosity adjustments and other conventional additive treatments. A suitable pigment for inclusion in the adhesive is Ecco Brite HL 7417 BK 4-710, available from Eastern Color and Chemical Co., 35 Livingston St., Providence, R.I. 02904. Other similar pigments can be substituted. The fibers used in the flocking process are the natural, undyed fibers, so that they have their normal translucent, whitish color.

Figure 3:
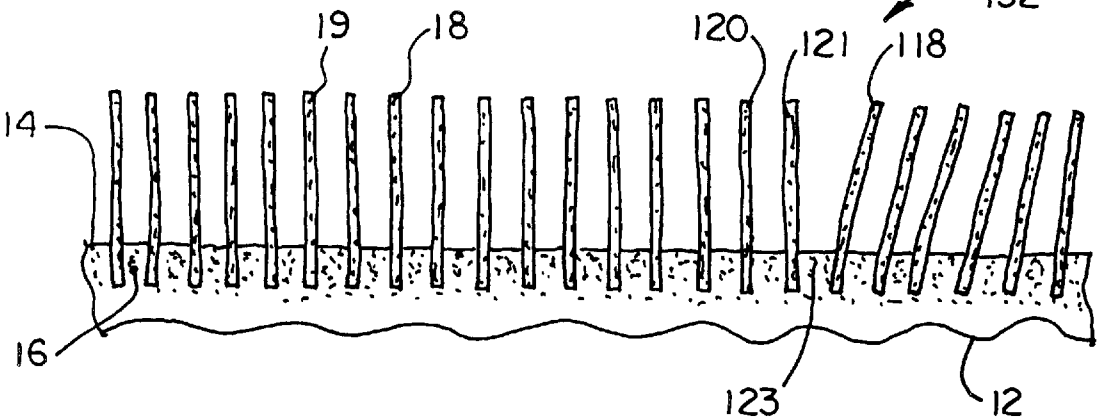
FIG. 3 is an enlarged, schematic view of an alternate embodiment of the fabric according to the invention.

If desired, the flocked fabric can be air texturized, a conventional procedure involving the application of an air flow to cause the fibers to be oriented on the fabric surface in a decorative pattern before the adhesive is allowed to set or cure. This results in a fabric 132 seen in FIG. 3 with some fibers 18, 118 being arrayed on the substrate in a textured array, so that some fibers 118 diverge from neighboring fibers 121 more than other fibers 120. The pigmented adhesive 123 is visible between the diverging fibers, but since it is a dark color, it contributes to the depth of shade effect, rather than being an objectionable grin-through.

Figure 1:
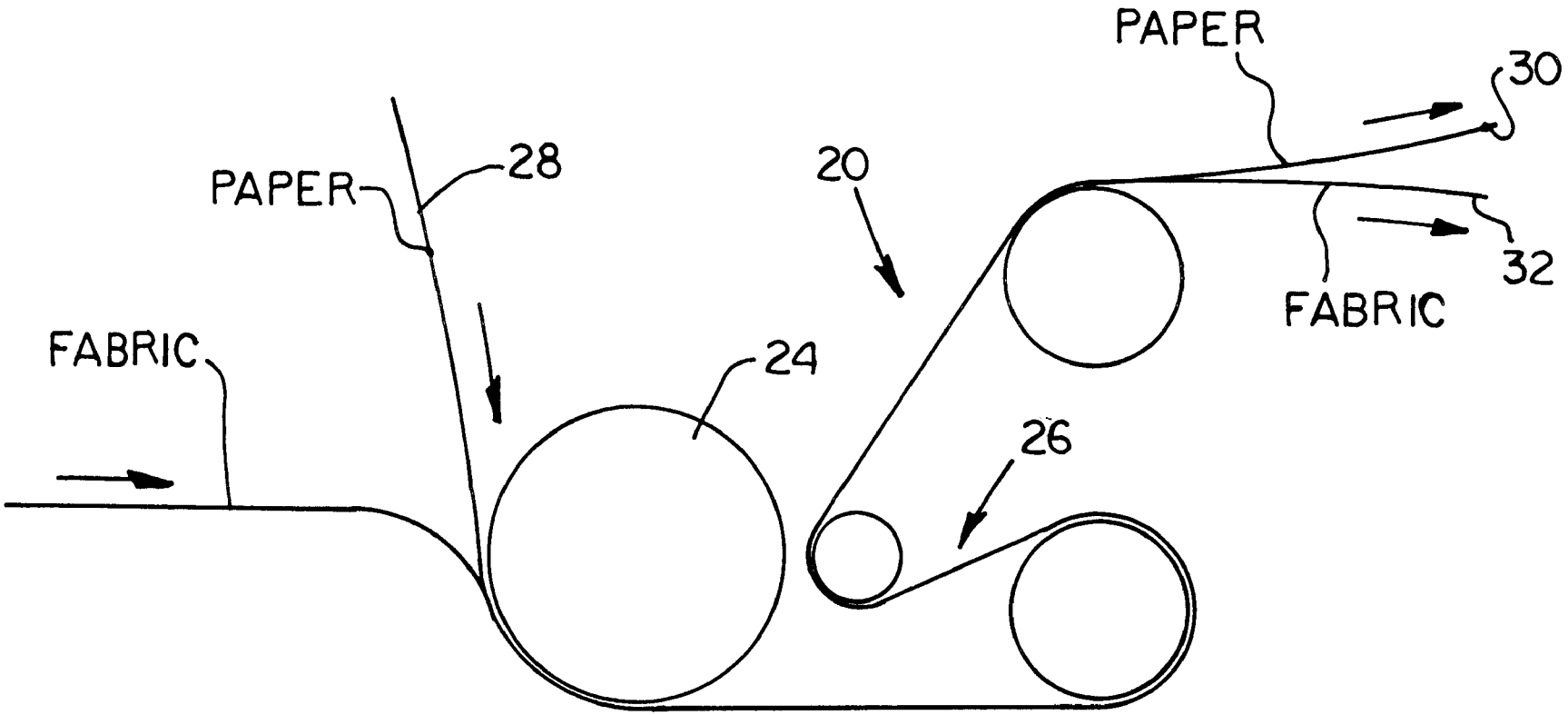
FIG. 1 is a schematic view of a transfer print process suitable for use in the present invention.

The fabric so made is fed into a conventional transfer printing machine, as shown schematically in FIG. 1. The fabric 22 is fed along with the transfer print paper 28 into the machine 20. A large, heated roll 24 puts the fabric into intimate contact with the paper and begins the sublimation process of the disperse dye on the paper 28 for impregnation into the fibers of the fabric 22. The combined paper and fabric follow a path 26 through additional rollers to provide enough residence time for complete sublimation of the disperse dye into the fibers of the fabric.

However, the pressure applied to the fabric need not be as great as when flocked fabrics are transfer printed conventionally. Since the dyestuff need only color the upper portions of the fibers, the damaging pressure conventionally used to penetrate to the depths of the pile need not be used. The result is that the pile remains more upright and erect, giving the fabric a softer and loftier hand than conventionally transfer printed flocked fabrics, as well as less grin-through and crocking. For example, when using a Gessner transfer print machine (available from Gessner Co., Greensboro, N.C. USA), pressures on the order of 60 pounds (27.3 kg) are used conventionally. With the invention, the pressure can be reduced to as low as 10 pounds (4.5 kg) for some print patterns and still achieve good depth of shade.

The fibers are any fibers which can be suitably transfer-printed. Presently thermoplastic fibers are known to be transfer-printable, with nylon and polyester fibers being the most common candidates for transfer-printing. The transfer-print dyestuffs are typically disperse dyes, well-known for printing and dyeing nylon and polyester.

Figure 2:
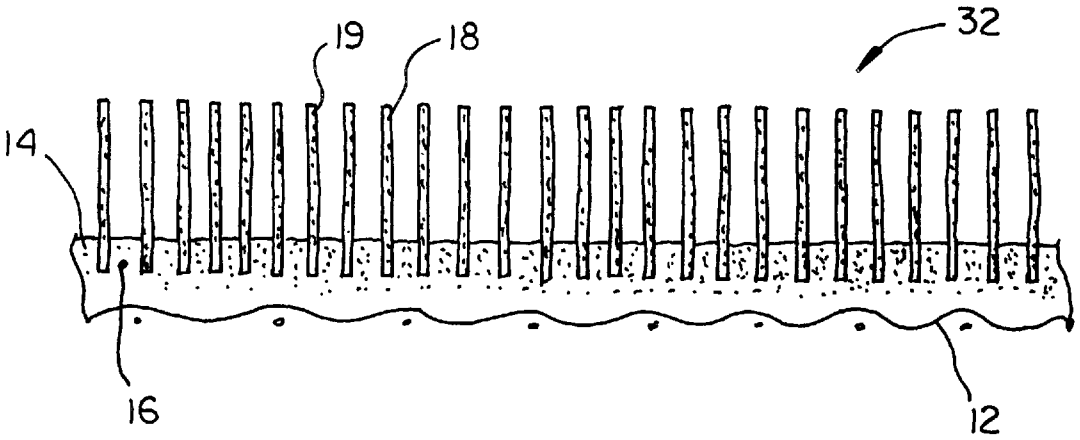
FIG. 2 is an enlarged, schematic view of the fabric according to the invention.

A schematic sectional view of the printed fabric can be seen in FIG. 2. The fabric 32 includes the substrate 12, which may be woven, as shown, or any the other suitable construction. Nylon fibers 18 are adhered to the substrate 12 with an adhesive 14 so that lower portions of the fibers are imbedded in the adhesive and upper portions form a nap standing up from the fabric. The adhesive 14 has pigment particles 16, shown schematically in FIG. 2, arrayed through it to give the adhesive an overall dark color, the color being determined by the color of the pigment particles 16. Similarly, the fibers 18 are colored by the disperse dye 19 which has impregnated into the upper portions of the fibers by the transfer printing process. Of course, the transfer print will form a pattern of various colors on various different portions of the fabric, depending on the print pattern. Also, the disperse dye will form a uniform dispersion in the thermoplastic fiber, but is shown only schematically in the figure as particulate colorations.

It is desirable to assure the upright orientation of the fibers in the fabric, and this can be done by two alternate methods. In the first, the fabric is heat set after the fibers are adhered to the substrate and before printing. Alternatively, the fabric can go straight from flocking to transfer-printing and be subjected to a thermal brushing after transfer-printing to restore the nap in the fabric.

The resulting fabric provides a deep, dark print which is crock-fast, and not subject to objectionable grin-through. Also, the hand is softer and loftier than conventionally transfer printed ficoked fabrics, largely because the pile is more erect.

Those of ordinary skill in the art will appreciate that the invention can be carried out in various other embodiments beyond the specific embodiments disclosed herein. These are deemed to be within the scope of the invention as claimed.

What is claimed is:

1. A transfer printed, flocked fabric comprising a textile substrate, raised thermoplastic fibers on the substrate, a dark pigmented adhesive adhering said fibers to said substrate and disperse dye distributed in a pattern in upper portions of said thermoplastic fibers.

2. A fabric as claimed in claim 1 wherein said disperse dye makes a deep, dark colored print.

3. A fabric as claimed in claim 1 wherein said pigment is black.

4. A fabric as claimed in claim 1 wherein said pigment is blue.

5. A fabric as claimed in claim 1 wherein said pigment is green.

6. A fabric as claimed in claim 1 wherein said upper portions of said fibers are colored only by disperse dye.

7. A fabric as claimed in claim 1 wherein said dyed pattern is crock-fast.

8. A fabric as claimed in claim 1 wherein said fibers are nylon.

9. A fabric as claimed in claim 1 wherein said fibers are polyester.

10. A fabric as claimed in claim 1 wherein said fibers are arrayed on said substrate in a textured array, so that some fibers diverge from neighboring fibers more than other fibers and said pigmented adhesive is visible between said diverging fibers.

11. A transfer printed, flocked fabric comprising a textile substrate, raised thermoplastic fibers on the substrate, an overall dark pigmented adhesive adhering lower parts of said fibers to said substrate and disperse dye distributed as a result of the transfer printing to form a pattern in upper portions only of the nap-forming part of said thermoplastic fiber, without said pattern-forming disperse dye penetrating to the depth of the nap.

12. A transfer printed, flocked fabric comprising a textile substrate, raised nylon fibers on said substrate, a black-pigmented adhesive adhering said nylon fibers to said substrate and disperse dye distributed in a pattern in upper portions of said nylon fibers and said upper portions of said nylon fibers being colored only by disperse dye, said fabric thereby forming a deep, dark, crock-fast, colored print.

13. A method of producing a transfer printed, flocked fabric comprising the steps of:

adhering undyed thermoplastic fibers to a substrate with a dark pigmented adhesive so that the fibers have a lower portion adhered to the substrate and an upper portion forming a nap and thereby forming a flocked fabric, and transfer printing the flocked fabric.

14. A method as claimed in claim 13 wherein said adhering step includes air texturizing the fibers on the substrate to cause some fibers to diverge from neighboring fibers more than other fibers and the pigmented adhesive is visible between the diverging fibers.

15. A method as claimed in claim 13 wherein said adhering step comprises adhering nylon fibers.

16. A method as claimed in claim 13 wherein said adhering step comprises adhering the fibers with a black pigmented adhesive.

17. A method as claimed in claim 13 further comprising heat setting the flocked fabric between the adhering step and the transfer printing step.

18. A method as claimed in claim 13 further comprising thermal brushing the flocked fabric after the transfer printing step.

19. A method as claimed in claim 13 wherein said transfer printing step comprises printing with a pattern having deep, dark colors.

20. A method of printing a flocked fabric comprising the steps of:

adhering undyed thermoplastic fibers to a textile substrate with an overall dark pigmented adhesive so that the fibers have a lower part adhered to the substrate and an upper part forming a nap and thereby forming a flocked fabric, and transfer printing the flocked fabric using a disperse dye so that said disperse dye is distributed to form a pattern in the upper portions only of the nap-forming part of the fibers without said pattern-forming disperse dye penetrating to the depth of the nap.

* * * * *